United States Patent [19]

Dunlap

[11] Patent Number: 4,703,139

[45] Date of Patent: Oct. 27, 1987

[54] METHOD IN A SNAP DOME SWITCH KEYBOARD ASSEMBLY FOR REDUCING CONTACT BOUNCE TIME

[75] Inventor: Bill D. Dunlap, Firestone, Colo.

[73] Assignee: KB Denver, Inc., Frederick, Colo.

[21] Appl. No.: 874,895

[22] Filed: Jun. 20, 1986

Related U.S. Application Data

[63] Continuation of Ser. No. 529,265, Sep. 6, 1983, abandoned.

[51] Int. Cl.[4] ..... H01H 13/70

[52] U.S. Cl. ..... 200/76; 200/5 A; 200/159 B; 200/288; 200/275

[58] Field of Search ..... 200/159 A, 159 B, 5 A, 200/275, 67 DB, 67 DA, 67 R, 302.2, 288, 76

[56] References Cited

U.S. PATENT DOCUMENTS

| | | | |
|---|---|---|---|
| 3,806,673 | 4/1974 | Boulanger | 200/5 A |
| 3,908,109 | 9/1975 | Studebaker | 200/275 |
| 3,917,917 | 11/1975 | Murata | 200/5 A |
| 3,967,084 | 6/1976 | Pounds | 200/275 |
| 3,995,128 | 11/1976 | Hawkins | 200/5 A |
| 3,999,025 | 12/1976 | Sims, Jr. | 200/159 B |
| 4,033,030 | 7/1977 | Robinson | 200/159 B X |
| 4,042,439 | 8/1977 | Pounds | 200/278 X |
| 4,085,306 | 4/1976 | Dunlap | 200/275 |
| 4,195,210 | 3/1980 | Pounds et al. | 200/159 A |
| 4,207,448 | 6/1980 | Furusawa et al. | 200/159 B |
| 4,254,309 | 3/1981 | Johnson | 200/5 A |
| 4,349,712 | 9/1982 | Michalski | 200/159 B |
| 4,362,911 | 12/1982 | Sears et al. | 200/5 A |
| 4,398,074 | 8/1983 | Danielson et al. | 200/159 B X |
| 4,417,294 | 11/1983 | Herron, Jr. | 200/159 B |
| 4,423,294 | 12/1983 | Walser et al. | 200/5 A |
| 4,430,531 | 2/1984 | Wright | 200/5 A |
| 4,463,234 | 7/1984 | Bennewitz | 200/159 B |
| 4,476,355 | 10/1984 | Mital | 200/5 A |
| 4,515,999 | 5/1985 | Harper | 200/5 A |
| 4,520,248 | 5/1985 | Woelfel | 200/5 A |

*Primary Examiner*—Henry J. Recla
*Assistant Examiner*—Ernest G. Cusick
*Attorney, Agent, or Firm*—Lloyd L. Zickert

[57] ABSTRACT

A snap dome switch keyboard assembly including a printed circuit board having dual contact switch sites with piggy-back snap domes, button actuators for each of the piggy-back snap domes, and an elastomeric member arranged between the domes and the button actuators serving as a force transmission member materially reducing the contact bounce time.

3 Claims, 9 Drawing Figures

METHOD IN A SNAP DOME SWITCH KEYBOARD ASSEMBLY FOR REDUCING CONTACT BOUNCE TIME

This application is a continuation application of my application Ser. No. 529,265, filed Sept. 6, 1983, now abandoned.

DESCRIPTION

This invention relates in general to a snap dome switch keyboard assembly, and more particularly to a keyboard assembly having dual contact switches to provide dual channels for telephone coding.

Heretofore, it has been known to provide keyboard assemblies utilizing dual contact switches for the telephone code and which also incorporates the use of piggy-back domes. However, such assemblies have been somewhat objectionable in that the switches have a high contact bounce time and the actuating buttons are corner sensitive, sometimes resulting in the failure to close one of the dual contacts which causes a malfunction.

The present invention overcomes the heretofore known difficulties by interposing a sheet or layer of elastomeric material such as rubber or a suitable plastic between the domes and the button actuators. Use of the elastomeric sheet not only materially reduces the contact bounce time but also materially improves the tactile feel. Moreover, it eliminates the corner sensitivity of the button actuators, thereby substantially eliminating malfunctions.

It is therefore an object of the present invention to provide a new and improved telephone code keyboard assembly which reduces contact bounce time and differential in bounce time of both contacts to eliminate dialing malfunctions, and renders the tactile feel more desirable.

It is a further object of this invention to provide an improved telephone code keyboard assembly which is more reliable in that any corner sensitivity of the button actuators that might cause a malfunction of the switching operation is eliminated.

Other objects, features and advantages of the invention will be apparent from the following detailed disclosure, taken in conjunction with the accompanying sheets of drawings, wherein like reference numerals refer to like parts, in which.

Figure 1:
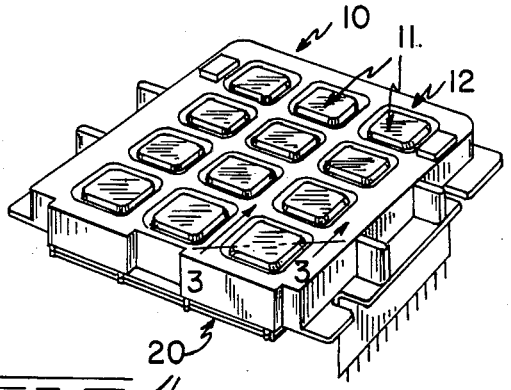
FIG. 1 is a perspective view of an assembled keyboard in accordance with the present invention.
Figure 2:
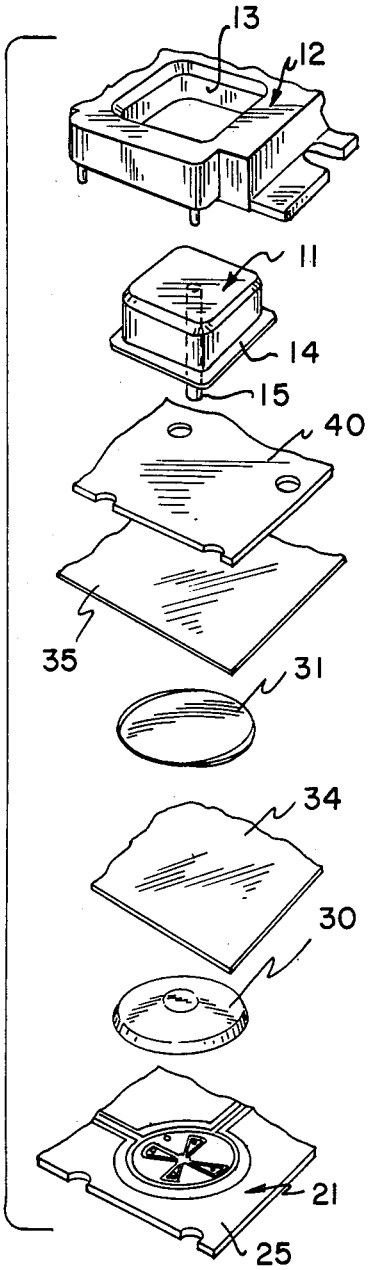
FIG. 2 is an exploded perspective view of one key area for the keyboard shown in FIG. 1.

Referring now to the drawings, and particularly to FIG. 1, one form of the keyboard assembly of the present invention, generally designated by the numeral 10, includes a plurality of buttons or keycaps 11 extending through openings in a bezel 12. The buttons 11 may also be referred to as button actuators as they serve to actuate the snap domes for closing the circuits within which the contacts are connected. As seen in FIG. 12, the bezel includes a plurality of button openings 13 within which a button actuator 11 is disposed and arranged so that relative movement between the button and the bezel can be easily accomplished upon depression of the button. A certain tolerance is built into the bezel and the buttons, that are molded of suitable plastic which defines a relatively loose mating relation between the button and the bezel, allowing ease of movement therebetween. Each button includes a lip 14 which, when arranged with the bezel opening 13, prevents the button actuator from moving upwardly through the opening and defines a home position. thus, the lip functions as a stop against the bezel when the button is in its uppermost position. Additionally, the button actuator 11 includes an actuating post or pin 15 which functions to engage and depress the snap dome switch means when the button is depressed, as will be explained more clearly hereafter.

Figure 5:
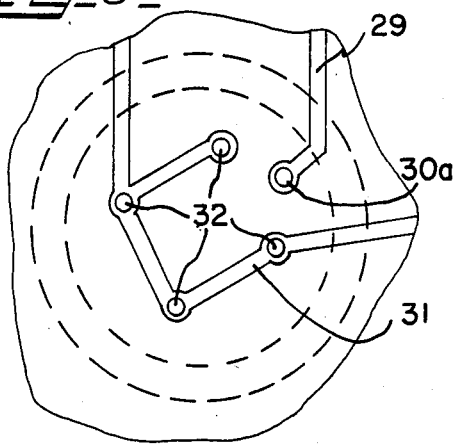
FIG. 5 is a bottom plan view of the printed circuit board at a switch site showing the conductive paths.
Figure 3:
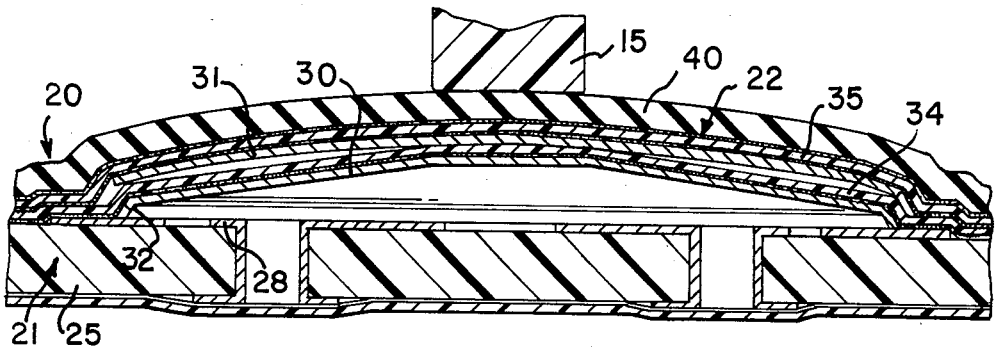
FIG. 3 is a greatly enlarged transverse sectional view taken through one key area of the keyboard and generally along line 3—3 of FIG. 1 and showing only a segment of the keycap or button.
Figure 6:
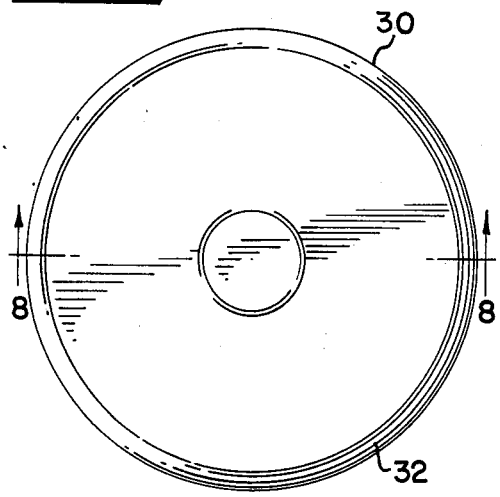
FIG. 6 is a greatly enlarged top plan view of the lower dome which is directly mountable on the switch site on the printed circuit board.
Figure 7:
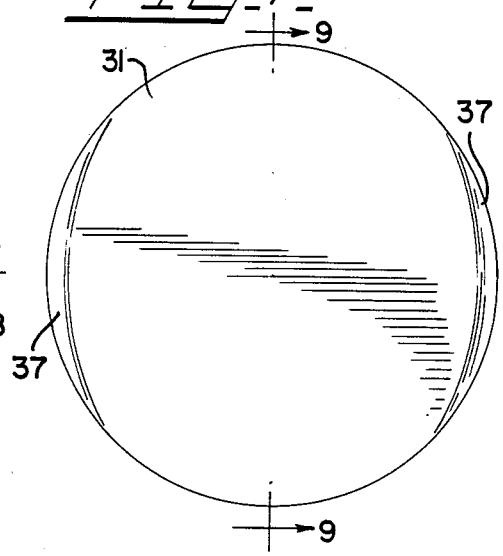
FIG. 7 is an enlarged top plan view of the upper dome.
Figure 8:
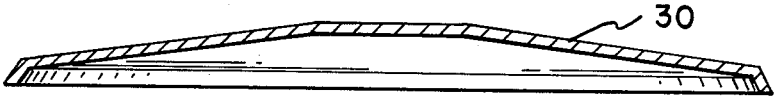
FIG. 8 is a transverse sectional view taken along line 8—8 of FIG. 6.
Figure 9:
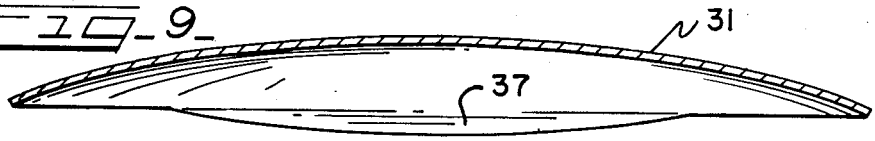
FIG. 9 is a transverse sectional view taken along line 9—9 of FIG. 7.

A printed circuit board switch subassembly 20, as seen in FIG. 3, is arranged to be associated with the bezel 12 and positioned relative thereto such that the button actuators are disposed in alignment with the snap dome switch means of the subassembly. The subassembly includes generally a printed circuit board 21 and a snap dome switch means 22. The printed circuit board 21 includes an electrically insulative substrate 25 onto which electrically conductive circuit paths are formed by any suitable process. On the upper side of the substrate 25, pie-shaped conductive segments or contacts 26 and 27 are arranged centrally within a circular or annular segment or contact 28. The segments 26, 27 and 28 constitute contacts for coaction with the snap dome switch means 22 to define switches for coding circuits. The underside of the board, as seen in FIG. 5, includes a conductive path 29 which is connected to a plated-through hole conductor 30*a* that is connected on the upper side of the substrate to the contacts 26, and a conductive path arrangement 31 connected to a plurality of platedthrough hole conductors 32 to the upper contacts 27. Accordingly, the pieshaped contacts 26 and 27, being connectable to different circuits, define a dual channel switching arrangement having the common contact 28. Upon depressing of the snap dome switch means, the contacts 26 and 27 are interconnected to the contact 28 by the contacting snap dome switch of the snap dome switch means 22 to close the circuits.

Figure 4:
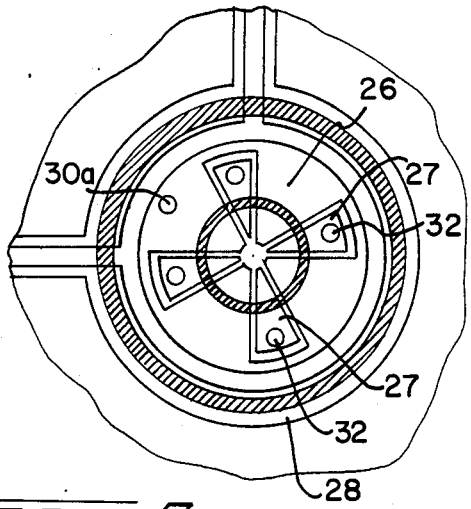
FIG. 4 is a greatly enlarged switch site on the printed circuit board of the assembly according to the invention showing the conductive paths and indicating in shaped lines the contact areas of the dome disposed directly on the upper side of the circuit board.

The snap dome switch means 22 includes a lower snap dome 30 and an upper snap dome 31. For brevity the snap domes will sometimes be called domes. The lower dome 30 is provided with a peripheral or marginal edge portion 32 that is in continual engagement with the circular contact 28 on the printed circuit board. Upon collapse and flattening of the dome 30, contact is made at the central area of the dome in a fashion similar to that shown in FIG. 4 which interconnects the contacts 26 and 27 with contact 28. The dome 30 is held in place and sealed to the printed circuit board by means of a plastic film or cover 34 having a pressure sensitive adhesive layer on its lower surface. This film may be of any desirable electrically insulative type, such as Mylar or the like and serves to load the domes on the board, retain them in position on the switch sites and seal them to the board against contamination, as more clearly disclosed in U.S. Pat. No. 4,042,439. The upper dome 31 is positioned against the plastic film 34 as illustrated in FIG. 3 and also held in place by a further plastic film 35 having an underlying adhesive layer. The plastic film 35 is of the same type as 34 and maintains the alignment of the upper dome 31 with the lower dome 30. Accordingly, the domes ride in piggy-back relation, the dome 31 being superposed relative to the dome 30.

Dome 30, which is directly positioned on the switch site having the contacts, is hat-shaped and provides full annular contact with all of the contacts when it is in collapsed position to define the best engagement with the switch contacts of the printed circuit board. This snap dome switch is of the type more fully described in U.S. Pat. No. 4,195,210.

The upper dome 31 is provided with a pair of opposed feet 37 and is of the type more clearly disclosed in U.S. Pat. No. 3,967,084, which provides a desired tactile feel. The piggy-back arrangement employed provides the best contact and tactile feel features needed to assure proper contact for the dual channels which is used as a telephone code switch while producing a good tactile feel. It therefore can be appreciated that, while the lower dome will not provide a crisp tactile feel, it will provide the best contact situation, while the upper dome, which cannot provide the best contact function because of the feet, can provide the crisp sharp tactile feel desired for a switch arrangement of this type.

The snap domes 30 and 31 are made of a suitable passivated stainless steel spring material with a 0.350 inch diameter, a 0.003 inch thickness, and a height of about 0.014 inch.

Between the snap dome switch arrangement 22 and the actuating post 15 of the button 11 is interposed a sheet or layer 40 of elastomeric material which has an underlying layer of pressure sensitive adhesive for purposes of allowing it to be applied directly to the uppermost plastic film 35 and held it in place. It may be appreciated that the elastomeric sheet may be used in place of the plastic film if so desired, thereby eliminating one layer of plastic film. The film thickness is on the order of 2 mil (0.002 inch).

The thickness of the elastomeric sheet, which may be of natural or synthetic rubber or other suitable plastic material, is preferably about 0.015 inches, but may be in the range of 0.005 to 0.125 inches. It also has a durometer hardness of about 60 although it may be in the range of between 10 and 80.

In the absence of using the elastomeric sheet 40, should the button actuating pin not apply force squarely to the snap dome switch means, thereby applying an off-center force which is highly possible because of the necessary loose fit between the bezel and the button actuators, such an off-center force can cause malfunctioning of the switch contacting function inasmuch as the contacts 26 and 27 may not be closed at the same time. Also, the contact bounce time of the snap dome switch in such an arrangement is relatively high. When one contact closes before the other, there exists a differential in contact bounce time between the contacts which causes a malfunction in the telephone dialing function, resulting in dialing of a wrong number. Moreover, the high contact bounce time can produce dialing malfunction.

Use of the rubber sheet in the present invention not only reduces contact bounce time of the contacting snap dome switch 30 but also eliminates any differential in contact bounce time between the contacts 26 and 27. Accordingly, dialing malfunctions are essentially eliminated. The elastomeric sheet 40 functions to smear or uniformly distribute the force of the pin or post 15 to the snap dome switch means to eliminate different contact bounce times and reduce contact bounce of the contacts 26 and 27 and produce simultaneous engagement of both contacts. The contact bounce times on both make and break are reduced to microseconds, while assemblies without the rubber sheet would be in the millisecond range. Moreover, the travel of the button is slightly increased and the sharpness of tactile feel is slightly reduced or softened, thereby providing a more desirable feel in operation of the switch.

In view of the foregoing, it can readily be appreciated that the placement of the elastomeric sheet between the button actuators and the snap dome switch means provides a keyboard assembly having superior performance as a telephone code keyboard.

It will be understood that modifications and variations may be effected without departing from the scope of the novel concepts of the present invention, but it is understood that this application is to be limited only by the scope of the appended claims.

I claim:

1. A method of reducing contact bounce time in a dual channel snap dome switch keyboard assembly, wherein the assembly includes a printed circuit board having conductive paths on both surfaces defining at least one switch site on one of said surfaces, said site including an outer ring shaped contact and inner first and second contacts providing dual channel circuit operation, electrically conductive snap dome switch means coacting with the switch site for normally maintaining said contacts open and for selectively closing said contacts when in a depressed and flattened state, said snap dome switch means including a single individual dome switch having a peripheral edge in continuous engagement with said ring shaped contact and a central portion in registry with said inner contacts and in engagement therewith when said snap dome switch means is flattened thereby bridging the contacts, means retaining said snap dome in registry with said switch site, a button actuator having a post in alignment with said snap dome switch means, and bezel means for retaining the button actuator in working relation with said board, said method including the step of disposing an elastomeric sheet of material between the post of said button actuator and said dome switch which receives and transmits the force applied to said button actuator to said dome switch.

2. A method of reducing contact bounce time and differential in bounce time in a dual channel snap dome switch keyboard assembly to a value that substantially eliminates malfunction, wherein the assembly includes a printed circuit board having conductive paths on the top and bottom surfaces with some paths on the top surface connected to some on the bottom surface, a plurality of switch sites defined on the top surface by the conductive paths, each site including an outer ring-shaped contact and inner first and second contacts, said inner contacts being connected to conductive paths on the bottom surface of said board, whereby said first and second inner contacts define dual channel circuit operation for telephone coding, an individual snap dome disposed at each switch site having a peripheral edge in continuous contact with said outer ringshaped contact and a central portion in registry with said first and second inner contacts such that upon being flattened by a force applied in the direction of the board the central portion engages said inner contacts to bridge them with the outer contact, and means retaining said snap domes in registry with said switch sites, a button actuator having an actuating post in alignment with each snap dome, said method including the step of disposing an elastomeric means between each post and each snap dome which transfers a force directly from each button actuator to the snap dome aligned therewith.

3. A method of reducing contact bounce time and differential in bounce time in a dual channel snap dome switch keyboard assembly to acceptable levels for telephone coding and eliminating actuator corner sensitivity, wherein the assembly includes a printed circuit board having conductive paths on the top and bottom surfaces with some paths on the top surface connected to some on the bottom surface, a plurality of switch sites defined on the top surface by the conductive paths, each site including an outer ring-shaped contact and inner first and second contacts, said inner contacts being connected to conductive paths on the bottom surface of said board, whereby said first and second inner contacts define dual channel circuit operation for telephone coding, a first individual snap dome disposed at each switch site having a peripheral edge in continuous contact with said outer ring-shaped contact and a central portion in registry with said first and second inner contacts such that upon being flattened by a force applied in the direction of the board the central portion engages said inner contacts to bridge them with the outer contact, a thin layer of flexible insulating material coated with pressure sensitive adhesive on one side which faces the printed circuit board and engages the first snap domes and the board to hold the domes in registry with the switch sites, a second individual snap dome in alignment with said first individual snap dome and against said layer of insulating material, a second thin layer of flexible insulating material coated with pressure sensitive adhesive on one side which faces the printed circuit board and engages said second snap domes to hold the second snap domes in alignment with said first snap domes and define superposed pairs of snap domes at each switch site, and a button actuator aligned with each pair of superposed snap domes, said method including the step of disposing a uniform in thickness elastomeric sheet of material directly between said button actuators and said pairs of snap domes, whereby application of a force to a button actuator is uniformly transmitted through said elastomeric sheet of material to an aligned pair of superposed snap domes.

* * * * *